US010890367B2

(12) United States Patent
Junge et al.

(10) Patent No.: US 10,890,367 B2
(45) Date of Patent: Jan. 12, 2021

(54) DOUBLE ROW BARREL ICE MAKER WITH OVERHEAD EXTRACTION

(71) Applicant: Haier US Appliance Solutions, Inc., Wilmington, DE (US)

(72) Inventors: Brent Alden Junge, Evansville, IN (US); John Keith Besore, Prospect, KY (US); Samuel Vincent DuPlessis, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 141 days.

(21) Appl. No.: 16/026,137

(22) Filed: Jul. 3, 2018

(65) Prior Publication Data

US 2020/0011581 A1 Jan. 9, 2020

(51) Int. Cl.
*F25C 5/04* (2006.01)
*F25C 1/24* (2018.01)

(52) U.S. Cl.
CPC . *F25C 5/04* (2013.01); *F25C 1/24* (2013.01)

(58) Field of Classification Search
CPC .... F25C 1/22; F25C 1/24; F25C 1/243; F25C 1/246; F25C 1/04; F25C 1/06; F25C 5/06; F25C 5/20; F25C 5/22; F25C 2400/06
See application file for complete search history.

(56) References Cited

U.S. PATENT DOCUMENTS 2,377,436 A * 6/1945 Mallard ..... F25C 1/24 62/135
2,947,156 A * 8/1960 Roedter ..... F25C 1/04 62/353
3,163,018 A * 12/1964 Shaw ..... F25C 1/04 62/137
3,200,612 A * 8/1965 Frohbieter ..... F25C 1/04 62/345
3,300,998 A * 1/1967 Jacobus ..... F25C 1/04 62/135
3,362,182 A * 1/1968 Walker ..... F25C 1/04 62/137
3,678,701 A * 7/1972 Powell ..... F25C 1/04 62/353
3,828,568 A * 8/1974 Frazier ..... F25C 1/04 62/186
3,850,008 A * 11/1974 Frazier ..... F25C 1/04 62/353
4,059,970 A * 11/1977 Loeb ..... F25C 1/04 62/353
4,942,742 A * 7/1990 Burruel ..... F25C 1/04 249/119

(Continued)

*Primary Examiner* — Jianying C Atkisson
*Assistant Examiner* — Miguel A Diaz
(74) *Attorney, Agent, or Firm* — Dority & Manning, P.A.

(57) ABSTRACT

An ice maker includes a mold body with two rows of mold cavities defined in the mold body. The ice maker also includes an ejector assembly having a plurality of ejector pads corresponding to the mold cavities. The ejector pads are movable between a low position proximate to the floor of a corresponding mold cavity and a high position proximate the opening of each corresponding mold cavity. The ejector pads are operable to eject ice from the mold cavities when the ejector assembly moves from the low position to the high position. A related refrigerator appliance is also provided.

16 Claims, 11 Drawing Sheets

(56) References Cited

U.S. PATENT DOCUMENTS

| | | | | |
|---|---|---|---|---|
| 6,820,433 | B2 * | 11/2004 | Hwang | F25C 1/10 62/237 |
| 7,263,835 | B2 * | 9/2007 | Lin | F25C 1/04 62/3.63 |
| 8,539,779 | B2 * | 9/2013 | Kim | F25C 5/02 62/71 |
| 9,151,527 | B2 | 10/2015 | Boarman et al. | |
| 9,234,689 | B2 | 1/2016 | Son et al. | |
| 10,345,024 | B2 * | 7/2019 | Besore | F25C 1/24 |
| 2006/0254285 | A1 * | 11/2006 | Lin | F25C 1/04 62/3.63 |
| 2010/0287959 | A1 * | 11/2010 | Kim | F25C 1/12 62/71 |
| 2010/0319366 | A1 * | 12/2010 | Kim | F25C 1/04 62/71 |
| 2014/0196479 | A1 * | 7/2014 | Miller | F25C 5/06 62/72 |
| 2014/0260347 | A1 * | 9/2014 | Cravens | F25C 5/04 62/71 |
| 2015/0114012 | A1 * | 4/2015 | Jafa | F25C 5/04 62/66 |
| 2019/0170420 | A1 * | 6/2019 | Besore | F25C 1/04 |
| 2019/0360736 | A1 * | 11/2019 | DuPlessis | F25C 1/20 |
| 2020/0025430 | A1 * | 1/2020 | Mitchell | F25C 5/22 |

* cited by examiner

DOUBLE ROW BARREL ICE MAKER WITH OVERHEAD EXTRACTION

FIELD OF THE INVENTION

The present subject matter relates generally to ice makers, and in particular to ice makers for forming barrel ice.

BACKGROUND OF THE INVENTION

Certain refrigerator appliances include an ice maker. An ice maker may also be a stand-alone appliance designed for use in commercial and/or residential kitchens. To produce ice, liquid water is directed to the ice maker and frozen. A variety of ice types can be produced depending upon the particular ice maker used. For example, certain ice makers include a mold body for receiving liquid water. The shape of the ice produced in such ice makers will generally correspond to the shape of the mold body. For example, refrigerator ice makers and other residential ice makers commonly include a mold body which produces crescent-shaped ice.

Many consumers, however, prefer barrel ice, which may be generally cylindrical in shape, over crescent-shaped ice pieces. Past attempts at providing an ice maker which produces barrel-shaped ice have met with difficulty. For example, some ice makers include a mold body with cylindrical mold cavities, where ice is harvested from the mold cavities by pushing the ice up out of the cavities from below, such as with a piston that passes through the bottom of at least one of the mold cavities. Such ice makers include a seal at the location(s) where the piston passes through the bottom of the mold cavity to prevent liquid water escaping the mold body. The movement of the piston may cause such seals to wear out prematurely.

Accordingly, an ice maker with features for producing and reliably harvesting barrel-shaped ice would be useful.

BRIEF DESCRIPTION OF THE INVENTION

Aspects and advantages of the invention will be set forth in part in the following description, or may be apparent from the description, or may be learned through practice of the invention.

In a first exemplary embodiment, an ice maker is provided. The ice maker defines a vertical direction, a lateral direction, and a transverse direction. The vertical, lateral, and transverse directions are mutually perpendicular. The ice maker includes a mold body. A plurality of mold cavities are defined in the mold body. The plurality of mold cavities includes a first row of mold cavities extending generally along the transverse direction and a second row of mold cavities extending generally along the transverse direction and spaced apart from the first row along the lateral direction. Each mold cavity of the plurality of mold cavities extends between a floor and an opening along a longitudinal axis. Each mold cavity of the plurality of mold cavities is enclosed by at least one sidewall between the floor and the opening. The longitudinal axis of each mold cavity is oriented generally along the vertical direction. The ice maker also includes an ejector assembly having a plurality of ejector pads. The plurality of ejector pads include a first row of ejector pads corresponding to the first row of mold cavities and a second row of ejector pads corresponding to the second row of mold cavities. Each ejector pad is disposed proximate to the floor of a corresponding mold cavity of the plurality of mold cavities when the ejector assembly is in a low position. The ice maker also includes a motor in operative communication with the ejector assembly. The motor is operable to move the plurality of ejector pads upward generally along the vertical direction from the low position to a high position proximate the opening of each corresponding mold cavity. Each ejector pad is operable to eject ice from the corresponding mold cavity when the ejector pad moves from the low position to the high position.

In a second exemplary embodiment, a refrigerator appliance is provided. The refrigerator appliance includes a cabinet that defines a chilled chamber. An ice maker is disposed within the cabinet. The ice maker defines a vertical direction, a lateral direction, and a transverse direction. The vertical, lateral, and transverse directions are mutually perpendicular. The ice maker includes a mold body. A plurality of mold cavities are defined in the mold body. The plurality of mold cavities includes a first row of mold cavities extending generally along the transverse direction and a second row of mold cavities extending generally along the transverse direction and spaced apart from the first row along the lateral direction. Each mold cavity of the plurality of mold cavities extends between a floor and an opening along a longitudinal axis. Each mold cavity of the plurality of mold cavities is enclosed by at least one sidewall between the floor and the opening. The longitudinal axis of each mold cavity is oriented generally along the vertical direction. The ice maker also includes an ejector assembly having a plurality of ejector pads. The plurality of ejector pads include a first row of ejector pads corresponding to the first row of mold cavities and a second row of ejector pads corresponding to the second row of mold cavities. Each ejector pad is disposed proximate to the floor of a corresponding mold cavity of the plurality of mold cavities when the ejector assembly is in a low position. The ice maker also includes a motor in operative communication with the ejector assembly. The motor is operable to move the plurality of ejector pads upward generally along the vertical direction from the low position to a high position proximate the opening of each corresponding mold cavity. Each ejector pad is operable to eject ice from the corresponding mold cavity when the ejector pad moves from the low position to the high position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
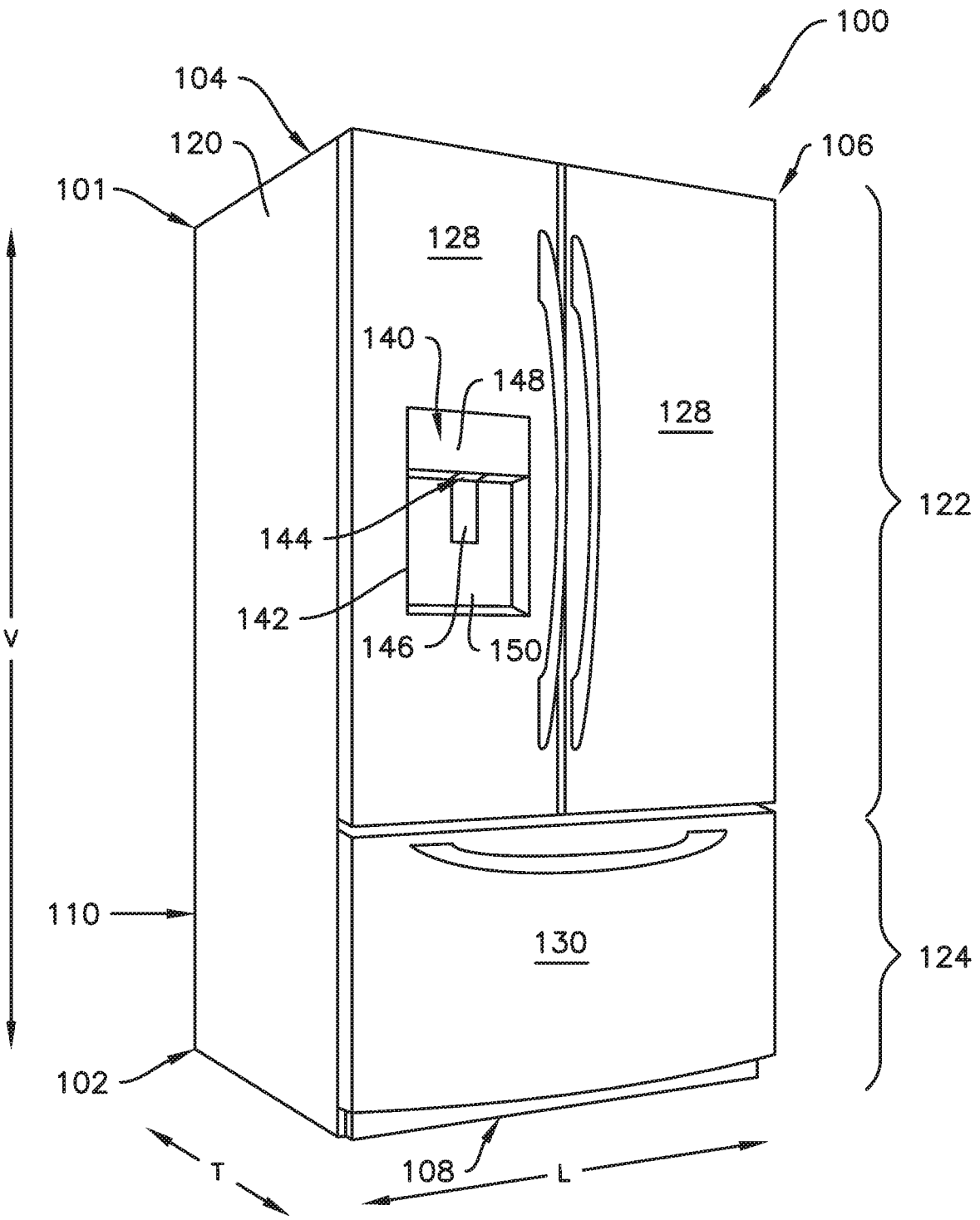
FIG. 1 provides a perspective view of a refrigerator appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

FIG. 1 provides a perspective view of a refrigerator appliance 100 according to an exemplary embodiment of the present subject matter. Refrigerator appliance 100 includes a cabinet or housing 120 that generally defines a vertical direction V, a lateral direction L, and a transverse direction T, each of which is mutually perpendicular, such that an orthogonal coordinate system is generally defined. The cabinet 120 extends between a top 101 and a bottom 102 along the vertical direction V, between a left side 104 and a right side 106 along the lateral direction L, and between a front 108 and a rear 110 along the transverse direction T. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance or a standalone ice maker appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122, e.g., at the left side 104 and the right side 106. In addition, a freezer door 130 is arranged below refrigerator doors 128 for selectively accessing freezer chamber 124. Freezer door 130 is coupled to a freezer drawer (not shown) mounted within freezer chamber 124 and slidable along the transverse direction T. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 128. Dispenser 142 includes a discharging outlet 144 for accessing ice and/or liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
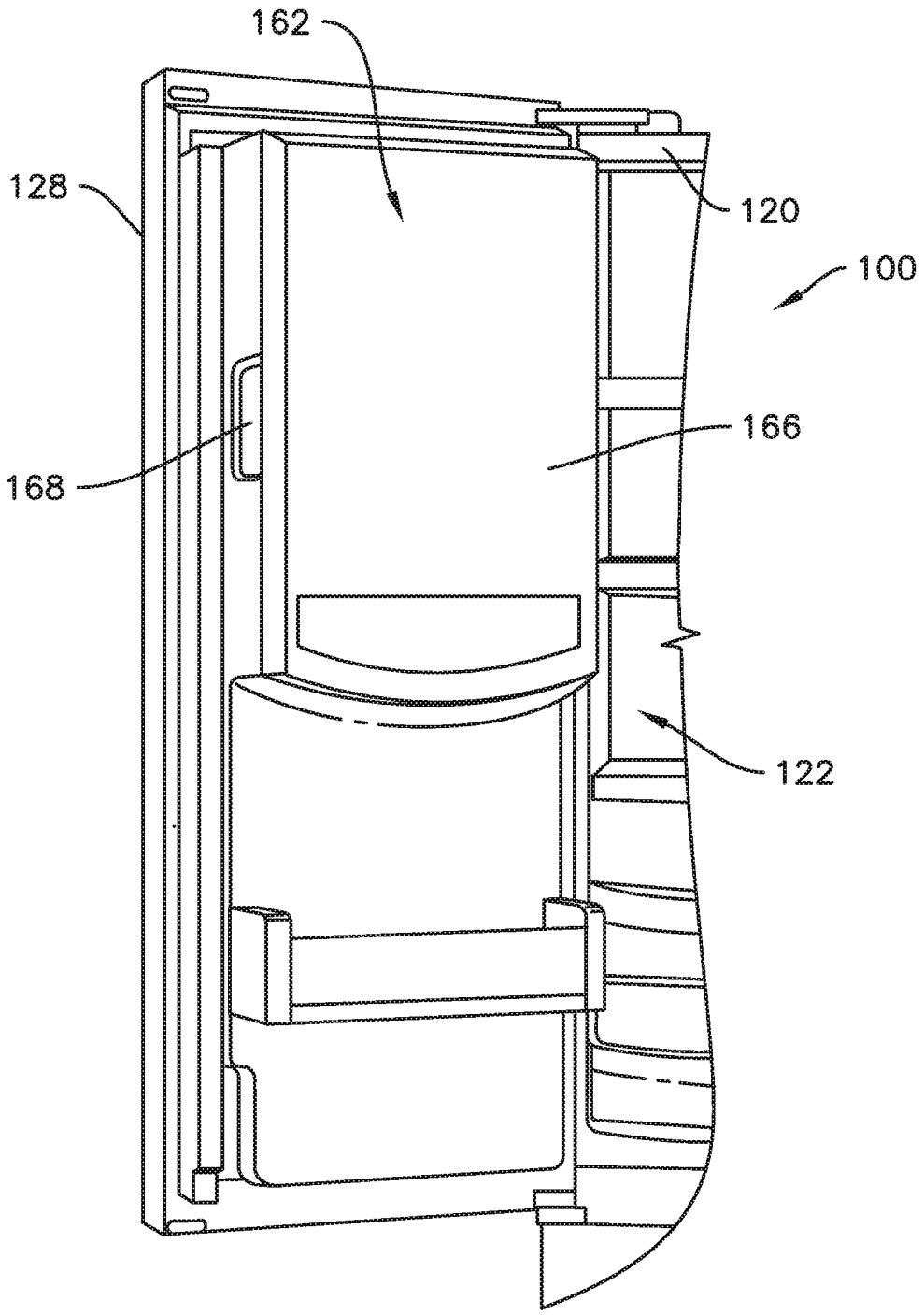
FIG. 2 provides a perspective view of a door of the exemplary refrigerator appliance of FIG. 1.
Figure 3:
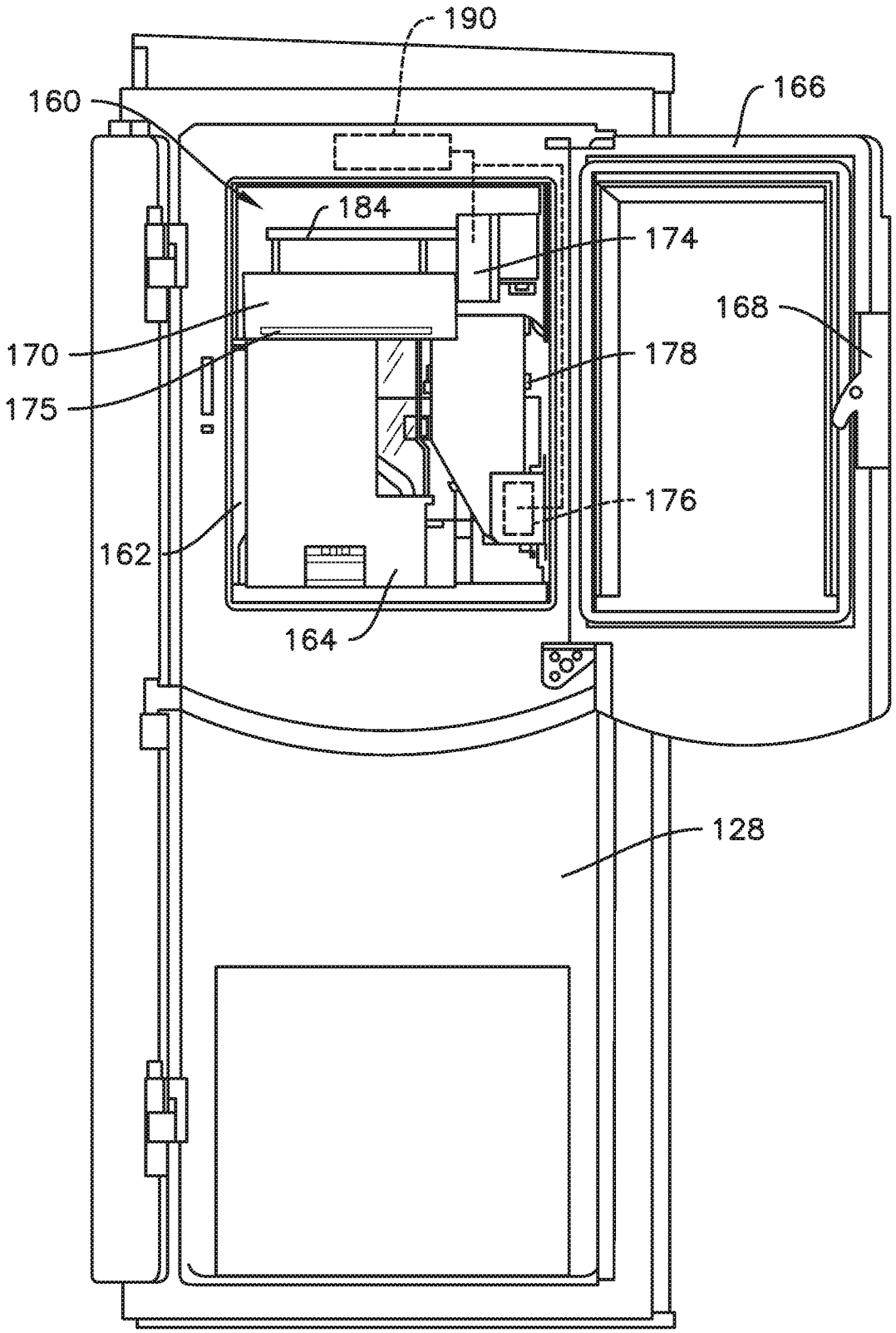
FIG. 3 provides an elevation view of the door of the exemplary refrigerator appliance of FIG. 2 with an access door of the door shown in an open position.

FIG. 2 provides a perspective view of a door of refrigerator doors 128. Refrigerator appliance 100 includes a sub-compartment 162 defined on refrigerator door 128. Sub-compartment 162 may be referred to as an "icebox." Sub-compartment 162 extends into fresh food chamber 122 when refrigerator door 128 is in the closed position. As shown in FIG. 3 and discussed in greater detail below, an ice maker or ice making assembly 160 and an ice storage bin 164 may be positioned or disposed within sub-compartment 162. Thus, ice is supplied to dispenser recess 150 (FIG. 1) from the ice maker 160 and/or ice storage bin 164 in sub-compartment 162 on a back side of refrigerator door 128. Chilled air from a sealed system (not shown) of refrigerator appliance 100 may be directed into components within sub-compartment 162, e.g., ice maker 160 and/or ice storage bin 164. As mentioned above, the present disclosure may also be applied to other types and styles of refrigerator appliances such as, e.g., a top mount refrigerator appliance, a side-by-side style refrigerator appliance or a standalone ice maker appliance. Accordingly, the description herein of the icebox 162 on the door 128 of the fresh food chamber 122 is by way of example only. In other example embodiments, the ice maker 160 may be positioned in the freezer chamber 124, e.g., of the illustrated bottom-mount refrigerator, a side by side refrigerator, a top-mount refrigerator, or any other suitable refrigerator appliance. As another example, the ice maker 160 may also be provided in a standalone icemaker appliance.

An access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162, e.g., by thermally isolating or insulating sub-compartment 162 from fresh food chamber 122.

FIG. 3 provides an elevation view of refrigerator door 128 with access door 166 shown in an open position. As may be seen in FIG. 3, ice maker 160 is positioned or disposed within sub-compartment 162. Ice maker 160 includes a mold body or casing 170. As described in more detail below, a motor 174 is mounted within sub-compartment 162, and is in mechanical communication with (e.g., coupled to) an ejector assembly 180 (FIGS. 6 and 7) for ejecting ice from the mold body 170. An ice bucket or ice storage bin 164 is positioned proximate the mold body 170 and receives the ice after the ice is ejected from the mold body 170. From ice storage bin 164, the ice can enter dispensing assembly 140 and be accessed by a user as discussed above. In such a manner, ice maker 160 can produce or generate ice.

Ice maker 160 also includes a fan 176. Fan 176 is configured for directing a flow of chilled air towards mold body 170. As an example, fan 176 can direct chilled air from an evaporator of a sealed system through a duct to mold body 170. Thus, mold body 170 can be cooled with chilled air from fan 176 such that ice maker 160 is air cooled in order to form ice therein. Ice maker 160 also includes a heater 175, such as an electric resistance heating element, mounted to or otherwise in thermal communication with mold body 170. Heater 175 is configured for selectively heating mold body 170, e.g., to assist in ejecting ice from the mold body 170.

Operation of ice maker 160 is controlled by a processing device or controller 190, e.g., that may be operatively coupled to control panel 148 for user manipulation to select features and operations of ice maker 160. Controller 190 can operate various components of ice maker 160 to execute selected system cycles and features. For example, controller 190 is in operative communication with motor 174, fan 176 and heater 175. Thus, controller 190 can selectively activate and operate motor 174, fan 176 and heater 175.

Controller 190 may include a memory and microprocessor, such as a general or special purpose microprocessor operable to execute programming instructions or micro-control code associated with operation of ice maker 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 174, fan 176 and heater 175 may be in communication with controller 190 via one or more signal lines or shared communication busses.

Ice maker 160 also includes a temperature sensor 178. Temperature sensor 178 is configured for measuring a temperature of mold body 170 and/or liquids, such as liquid water, within mold body 170. Temperature sensor 178 can be any suitable device for measuring the temperature of mold body 170 and/or liquids therein. For example, temperature sensor 178 may be a thermistor or a thermocouple or a bimetal. Controller 190 can receive a signal, such as a voltage or a current, from temperature sensor 190 that corresponds to the temperature of the mold body 170 and/or liquids therein. In such a manner, the temperature of mold body 170 and/or liquids therein can be monitored and/or recorded with controller 190. Some embodiments can also include an electromechanical icemaker configured with a bimetal to complete an electrical circuit when a specific temperature is reached. By completion of the circuit, the heater 175 and ejector mechanism would be activated via electrical powering of the motor 174.

Figure 4:
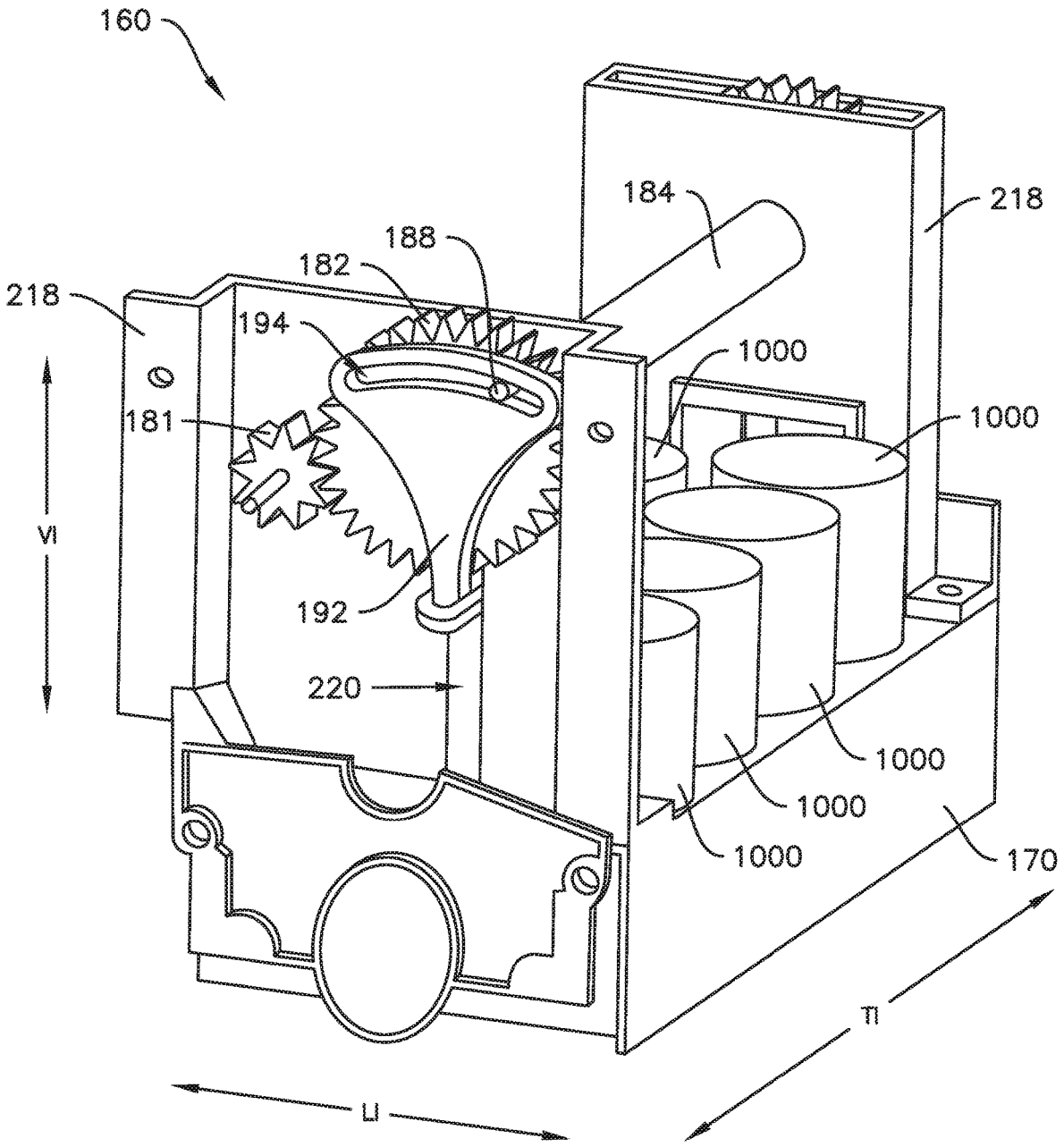
FIG. 4 provides a perspective view of an ice maker according to one or more exemplary embodiments of the present subject matter.
Figure 5:
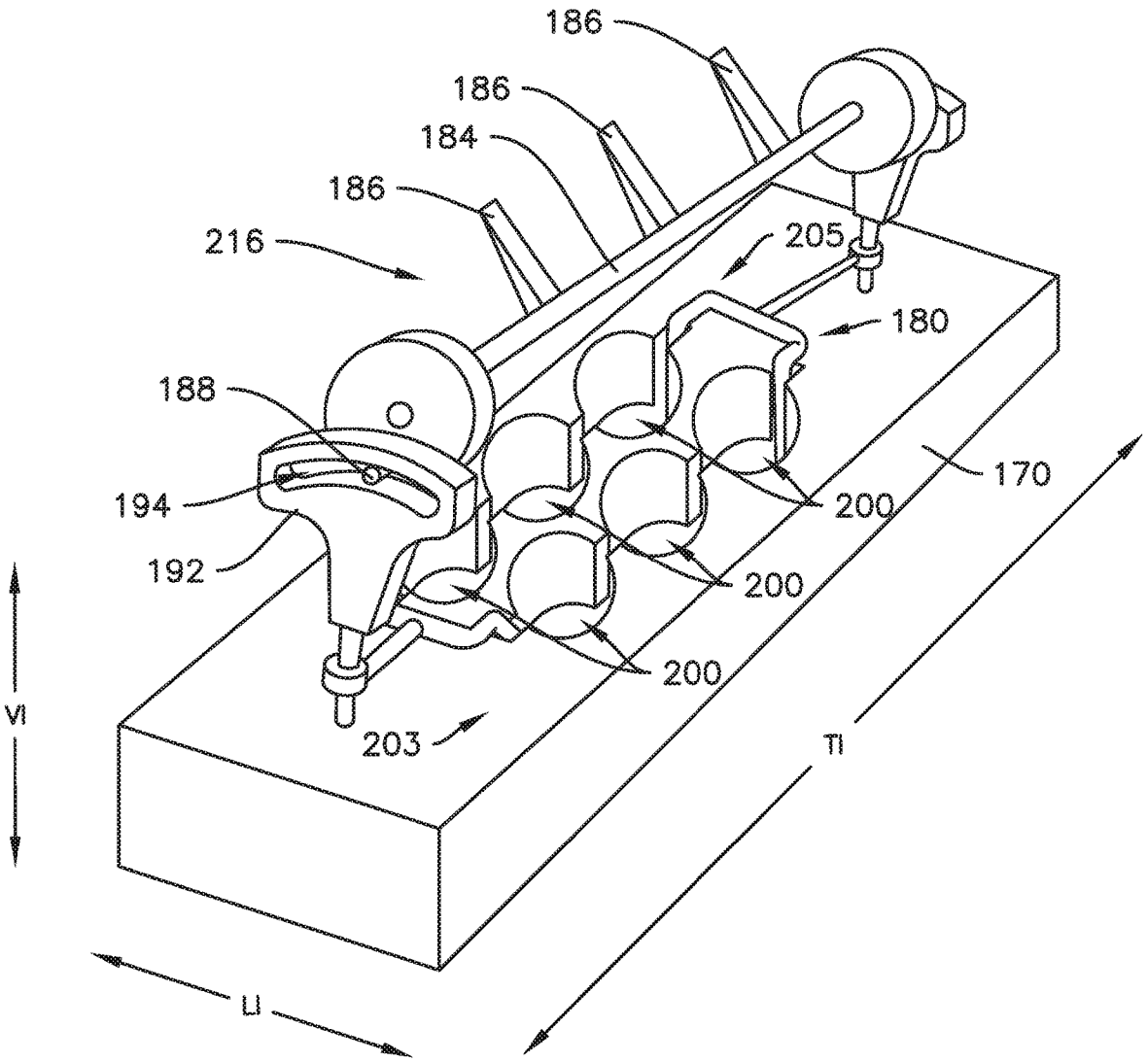
FIG. 5 provides another perspective view of an ice maker according to one or more exemplary embodiments of the present subject matter.

FIG. 4 provides a perspective view of the ice maker 160 and FIG. 5 provides a similar view with some components not shown for clarity. The ice maker 160 defines a vertical direction VI, a lateral direction LI, and a transverse direction TI. In exemplary embodiments wherein the ice maker 160 is installed in a refrigerator appliance 100, the ice maker 160 may installed such that the vertical direction VI of the ice maker 160 generally corresponds to the vertical direction V of the cabinet 120. As noted above, terms of approximation such as "generally" or "about" are used herein to include within ten percent greater or less than the stated value. In the context of an angle or direction, such terms include within ten degrees greater or less than the stated angle or direction. For example, the ice maker 160 may be installed such that the vertical direction VI of the ice maker 160 generally corresponds to the vertical direction V of the cabinet 120 when the vertical direction VI is aligned with, or within ten degrees in any direction of, the vertical direction V.

As may be seen in FIGS. 4 and 5, the mold body 170 of ice maker 160 includes a plurality of mold cavities 200 defined in the mold body 170 for forming ice 1000 therein. In the example illustrated by FIG. 5, the mold body 170 includes six mold cavities 200. In other embodiments, more or fewer mold cavities 200 may be included. The plurality of mold cavities 200 may include a first row 203 of mold cavities 200 extending generally along the transverse direction TI and a second row 205 of mold cavities 200 extending generally along the transverse direction TI and spaced apart from the first row 203 along the lateral direction LI.

The mold cavities 200 may be configured to receive liquid water to form ice 1000 in each mold cavity 200. As will be understood, the shape of ice 1000 formed in the mold cavities 200 will correspond to the shape of the mold cavity 200. The mold cavities 200 may be generally cylindrical. Accordingly, generally cylindrical ice, sometimes referred to as "barrel ice," may be produced by the ice maker 160, e.g., the ice 1000 may be ice barrels 1000. Example embodiments of the generally cylindrical mold cavity 200 may include tapered sidewalls, e.g., forming an angle of up to ten degrees with a floor 202 of the mold cavity 200, convex sidewalls, and/or concave sidewalls. In some embodiments, the generally cylindrical mold cavity 200 may have any suitable cross-sectional shape, e.g., hexagonal, instead of a round, e.g., circular or oval, cross-section.

Figure 6:
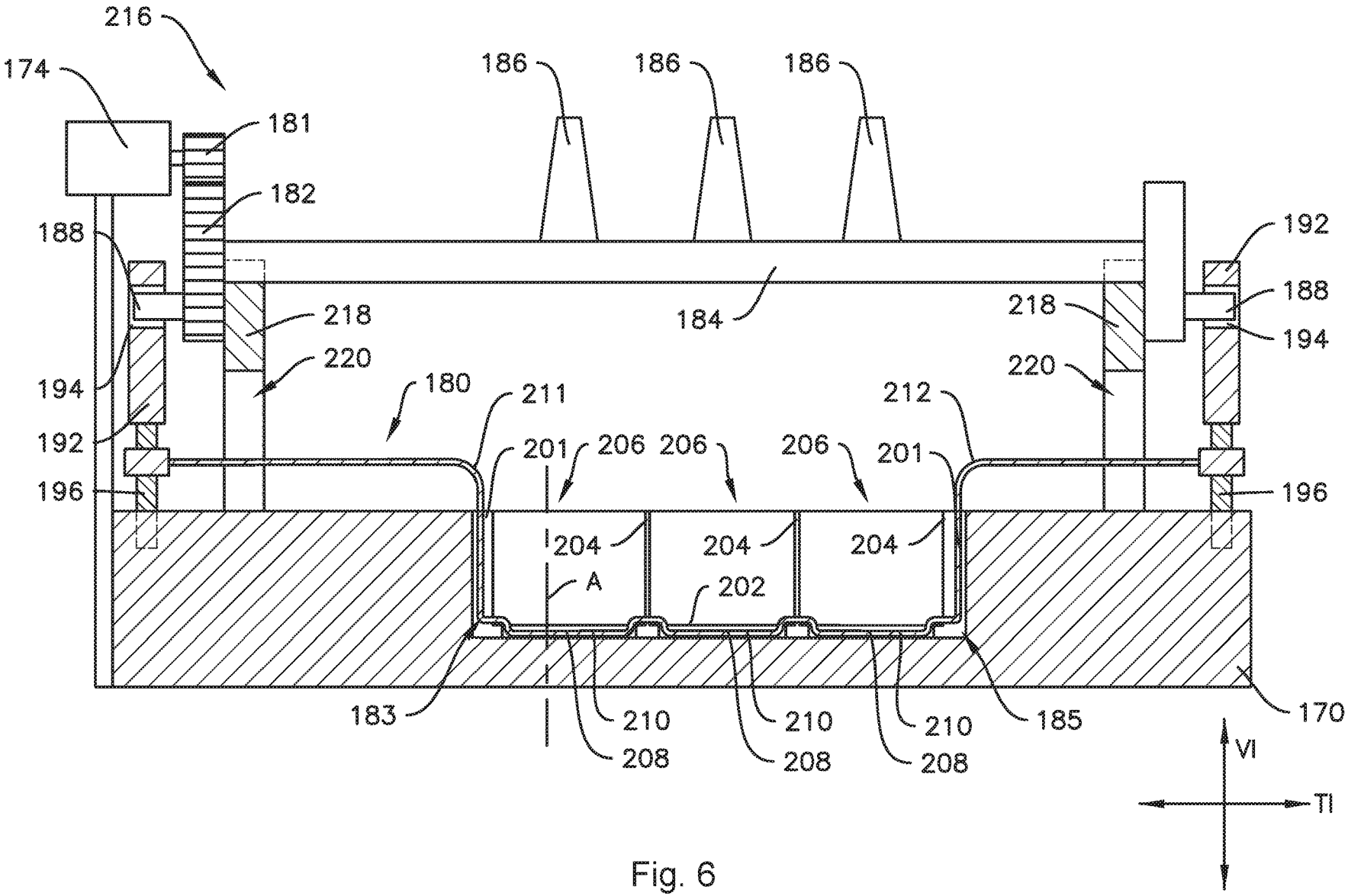
FIG. 6 provides a side section view of the ice maker of FIG. 4 with an ejector assembly in a low position.
Figure 7:
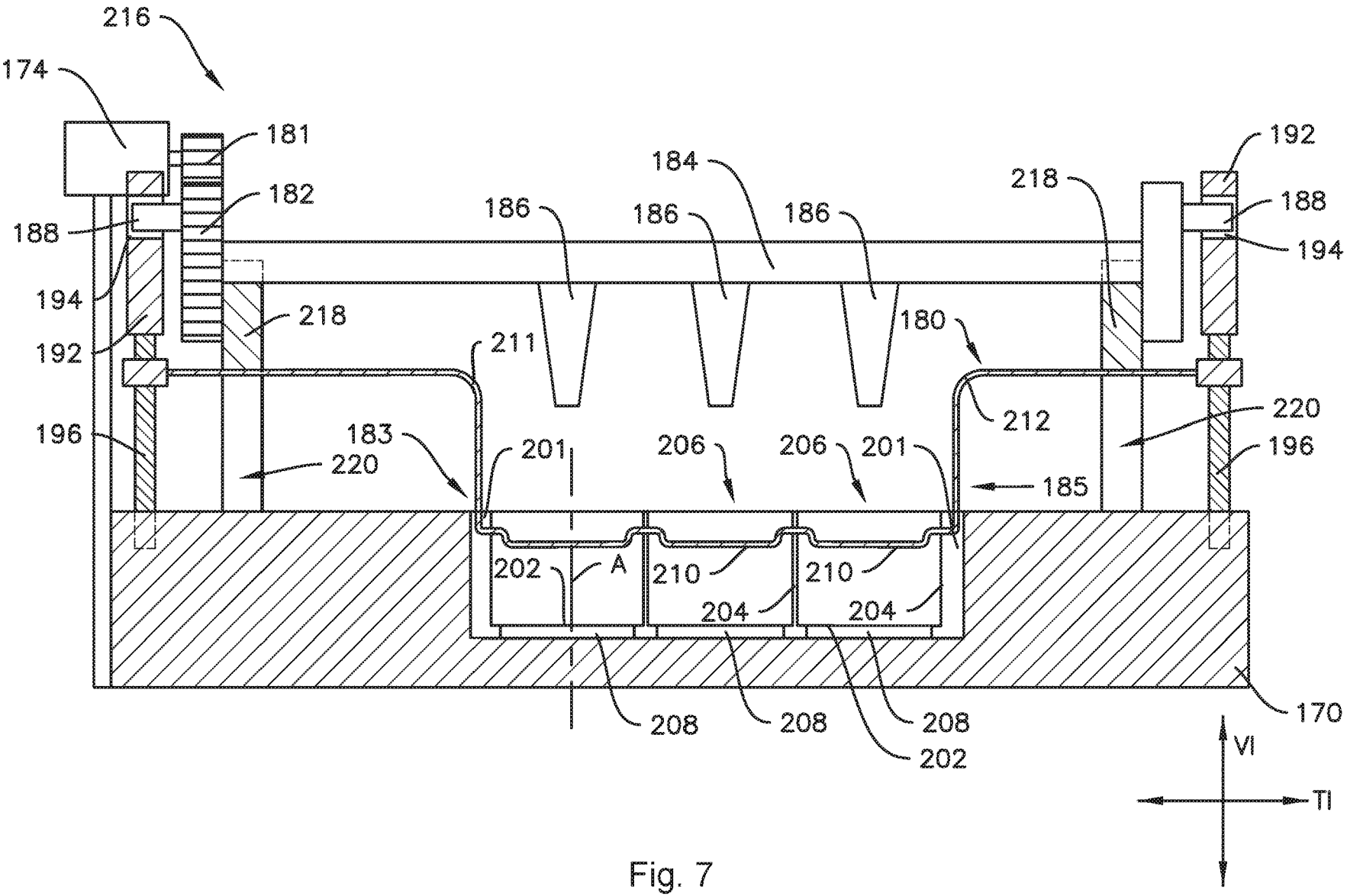
FIG. 7 provides a side section view of the ice maker of FIG. 4 with the ejector assembly in a high position.

The ice maker 160 may include an ejector assembly 180. As shown in FIGS. 6 and 7, the ejector assembly 180 may include a plurality of ejector pads 210. The plurality of ejector pads 210 may correspond to the plurality of mold cavities 200, e.g., the plurality of ejector pads 210 may include a first row 207 (FIG. 9) of ejector pads 210 corresponding to the first row 203 of mold cavities 200 and a second row 209 (FIG. 9) of ejector pads 210 corresponding to the second row 205 of mold cavities 200. For example, in embodiments where the mold body 170 includes six mold cavities 200, the ejector assembly 180 may include six ejector pads 210. Each ejector pad 210 is located within a corresponding mold cavity 200. As best seen in FIGS. 6 and 7, each of the mold cavities 200 extends between a floor 202 and an opening 206 along a longitudinal axis A. As may be seen in FIGS. 4 through 7, each mold cavity 200 is enclosed between the floor 202 and the opening 206 by at least one sidewall 204. For example, in the illustrated embodiments, the sidewall 204 is generally cylindrical. As noted above, in other embodiments, the mold cavities 200 may be, e.g., hexagonal, and thus may include more than one, e.g., six, sidewalls 204 enclosing each mold cavity 200 between the floor 202 and the opening 204. The longitudinal axis A of each mold cavity 200 is oriented generally along the vertical direction VI of the ice maker 160, and may in some embodiments also be generally aligned with the vertical direction V of the refrigerator appliance 100. As seen in FIGS. 5 through 7, a recess 208 may be formed in the floor 202 of the mold cavity 200. The floor 202 of the mold cavity 200, including the recess 208 formed therein, defines a solid and continuous surface, such that there is no inherent potential leak path for liquid water in the mold cavity 200. For example, no openings or apertures are located in or through the floor 202 for the ejector pads 210 or any associated mechanisms.

As illustrated, an ejector pad 210 is provided in each mold cavity 200. The ejector pads 210 in each adjacent mold cavity 200 may be connected together as part of the ejector assembly 180. The ejector assembly 180, and in particular the plurality of ejector pads 210 thereof, may be movable between a low position (FIG. 6) proximate the floor 202 and a high position (FIG. 7) proximate the opening 206. The ejector pads 210 may advantageously be rigidly secured to one another so that the ejector pads 210 move in unison between the low position and the high position. Each ejector pad 210 may be configured to be received within the recess 208 in the floor 202 of the corresponding mold cavity 200 when the ejector assembly 180 is in the low position. For example, the recess 208 may be circular and the ejector pad 210 may have a similar shape and size, e.g., circular and with a similar diameter, as the recess 208. As will be described in more detail below, the ejector assembly 180 may be movable upward generally along the vertical direction VI from the low position to the high position. As mentioned, each ejector pad 210 is in or near the recess 208 in the floor 202 of each corresponding mold cavity 200 when the ejector assembly 180 is in the low position. Further, when the ejector assembly 180 is in the high position, the ejector pad 210 is proximate the opening 206 of the mold cavity 200. Accordingly, when ice 1000 (FIG. 4) is formed within the mold cavity 200, moving the ejector pad 210 from the low position to the high position may eject the ice 1000 from the mold cavity 200, e.g., as shown in FIG. 4.

In various embodiments, the motor 174 may be in operative communication with the ejector assembly 180, such that the motor 174 is operable to move the plurality of ejector pads 210 generally along the vertical direction VI between the low position and the high position. For example, the ice maker 160 may include a gear 182 which is engaged by a drive gear 181 of the motor 174 such that activating the motor 174 causes the gear 182 to rotate. The gear 182 is illustrated schematically in FIGS. 4, 6, and 7 for the sake of clarity, the structure and operation of a gear is well understood by those of skill in the art. The gear 182 may be connected to a rotatable shaft 184 such that the rotatable shaft 184 rotates when the gear 182 rotates. Motor 174 may further be in communication with the ejector assembly 180 via a cam 188 and a scotch yoke 192, as described in more detail below.

As shown in FIGS. 4 through 7, the ice maker 160 may include an ice rake 216 positioned above the mold body 170 along the vertical direction VI. The ice rake 216 may include a rotatable shaft, e.g., the rotatable shaft 184 described above, and at least one rake finger 186 extending radially outward from the rotatable shaft 184. In various embodiments, any suitable number of fingers 186 may be provided, e.g., the number of rake fingers 186 may correspond to the total number of mold cavities 200 in the plurality of mold cavities 200, or may correspond to the number of mold cavities 200 in one of the first row 203 and the second row 205. For example, the ice rake 216 may include three rake fingers 186 where the plurality of mold cavities 200 includes six mold cavities 200 with three mold cavities 200 in the first row 203 and three mold cavities 200 in the second row 205, e.g., as shown in the example illustrated by FIG. 5.

As mentioned above, the ejector pads 210 may eject ice from each mold cavity 200 when the ejector assembly 180 moves from the low position to the high position. The ice rake 216 may be operable to dislodge the ice from the ejector pads 210 and/or mold cavity 200 and direct the ice towards the ice storage bin 164. For example, the ice maker 160 may be configured, e.g., the fingers 186 of the ice rake 216 may be positioned on the rotatable shaft 184, such that the fingers 186 of the ice rake 216 pass over and close to the mold body 170 when the rotatable shaft 184 rotates to or towards the high position of the ejector assembly 180. In particular, the rake fingers 186 sweep over the mold cavities 200 in a direction towards the ice storage bin 164 to direct the ice from the mold body 170 towards the ice storage bin 164. The rake fingers 186 may define a path of rotation, e.g., as the rotatable shaft 184 rotates, the fingers 186 extending therefrom may travel through a generally circular path. The rake fingers 186 may be positioned and oriented on the rotatable shaft 184 such that the rake fingers 186 pass through a bottom point of the path of rotation with respect to the mold body 170 when the ejector assembly 180 is in or approaches the high position. For example, the bottom point of the path of rotation may be the closest point of the rake fingers 186 to the mold body 170, e.g., where the rotatable shaft 184 is above the mold body 170. Accordingly, rotation of the rotatable shaft 184 may simultaneously eject ice upward out of the mold cavity 200 with the ejector assembly 180 and dislodge the ice from the mold body 170 and direct the ice into the ice storage bin 164 with the rake fingers 186.

For example, in embodiments where the number of rake fingers 186 corresponds to the number of mold cavities 200 in only one of the first row 203 and the second row 205, the ice maker 160 may be configured such that the rake fingers 186 initially contact the ice barrels 1000 of one of the first row 203 and the second row 205 as the rake fingers 186 approach the mold body 170. The rake fingers 186 may then dislodge the ice barrels 1000 of the one of the first row 203 and the second row 205 from the mold body 170, whereupon the rotatable shaft 184 continues to rotate and pushes the ice barrels 1000 of the one of the first row 203 and the second row 205 into the ice barrels 1000 of the other of the one of the first row 203 and the second row 205, thereby sweeping both rows of ice barrels 1000 towards the ice storage bin 164.

In some embodiments, a cam 188 may be formed on the gear 182 and thus the cam 188 may be connected to the rotatable shaft 184 via the gear 182. The ice maker 160 may also include a scotch yoke 192 having an slot 194 formed in the scotch yoke 192. The cam 188 may be received in the slot 194 of the scotch yoke 192, whereby rotation of the gear 182 is translated into reciprocating linear movement by the scotch yoke 192. The slot 194 may be arcuate, e.g., as illustrated in FIG. 4, whereby the speed of movement may be slightly biased so the ejector pad 210 will lift a little more slowly at the beginning of harvest as ice formed in the mold body 170 breaks loose from the mold body 170 and the cam 188 is close to six o'clock and the ejector pad 210 will lift faster when the cam 188 is closer to twelve o'clock. Thus, in various embodiments, the motor 174 may be in operative communication with the ejector assembly 180 via the gear 182, the cam 188, and the rotatable shaft 184.

In particular, the scotch yoke 192 may translate the rotation into upward linear movement along the vertical direction VI from the low position to the high position when the gear 184 rotates about one hundred eighty degrees (180°) and may translate the rotation into downward linear movement along the vertical direction VI from the high position to the low position when the gear 184 rotates an additional about one hundred eighty degrees (180°) to complete a revolution of the gear 184. Accordingly, the scotch yoke 192 may be connected to the ejector assembly 180, whereby the linear movement along the vertical direction VI moves the ejector assembly, in particular the ejector pads 210 thereof, between the low position and the high position. For example, as illustrated, two scotch yokes 192 may be provided, each connected to the ejector assembly 180 by a vertical rod 196. The vertical rod 196 may be telescopic such that the rod 196 extends as the ejector pad 210 moves from the low position to the high position and contracts as the ejector pad 210 moves from the high position to the low position. Each scotch yoke 192 may be provided at an opposite end of the rotatable shaft 184 in a similar fashion as the other scotch yoke 192.

The rotatable shaft 184 may be held in position and structurally supported above the mold body 170 by a strut or wall 218. The wall 218 may extend vertically, e.g., generally along the vertical direction V and/or VI, between the mold body 170 and the rotatable shaft 184. A slot 220 may be formed in the wall 218 such that the ejector assembly 180 may pass through the wall 218. The slot 220 may define a vertical dimension, e.g., a height, sufficient to allow the ejector assembly 180 to move from the low position to the high position without interference from the wall 218. Additionally, as shown in FIGS. 4-7, a second wall 218 may be provided which is identical to the wall 218 as described and shown.

Figure 8:
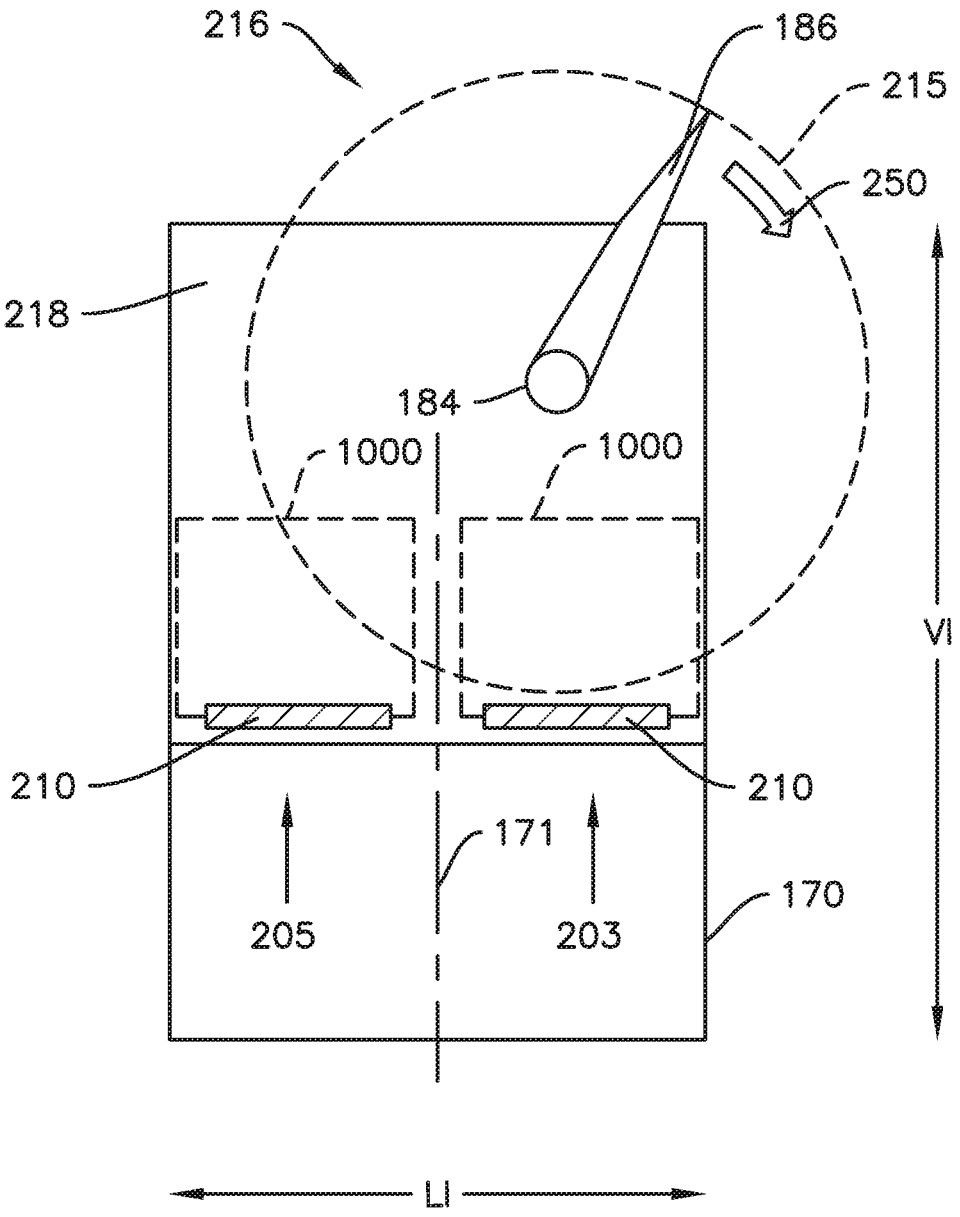
FIG. 8 provides a schematic view of ejector components of the ice maker of FIG. 4.

FIG. 8 schematically illustrates the position of the ice rake 216 relative to the mold body 170 and other components of the ice maker 160. In FIG. 8, the ejector pads 210 are shown in the high position and ice barrels 1000 ejected from the mold body 170 on the ejector pads 210 are shown in dashed lines. As shown in FIG. 8, when the rotatable shaft 184 rotates as described above, the rake fingers 186 extending therefrom travel along a circular path 215, e.g., clockwise as shown by arrow 250 in FIG. 8. Also shown in FIG. 8, the rake fingers 186 rotate through and within a plane defined by the vertical direction VI and the lateral direction LI. The ice rake 216, in particular the rotatable shaft 184 thereof, may be offset, e.g., from a center 171 of the mold body 170. As shown in FIG. 8, the mold body 170 may be generally symmetrical along the lateral direction LI, with each of the first row 203 and the second row 205 approximately equally spaced from the center 171 on opposite sides of the center 171. The rotatable shaft 184 may be offset from the center 171 by about one-half of the size, e.g., diameter, of one of the mold cavities 200. The rotatable shaft 184 may be positioned directly above the first row 203 of mold cavities 200 along the vertical direction VI, e.g., the rotatable shaft 184 may be positioned directly above or approximately directly above a center of the first row 203 of mold cavities 200.

Figure 9:
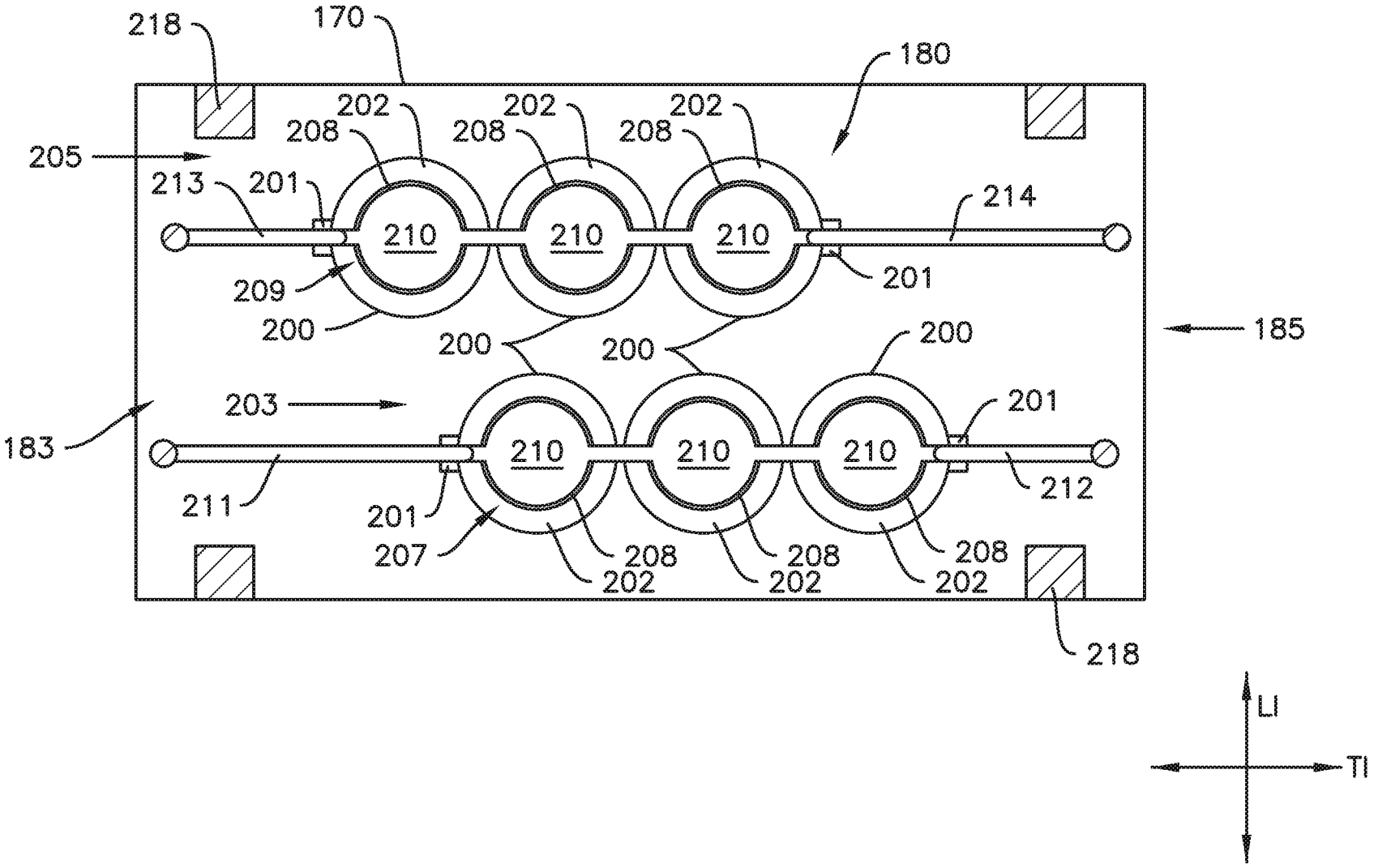
FIG. 9 provides a top-down section view of an ice maker according to one or more embodiments of the present subject matter.
Figure 10:
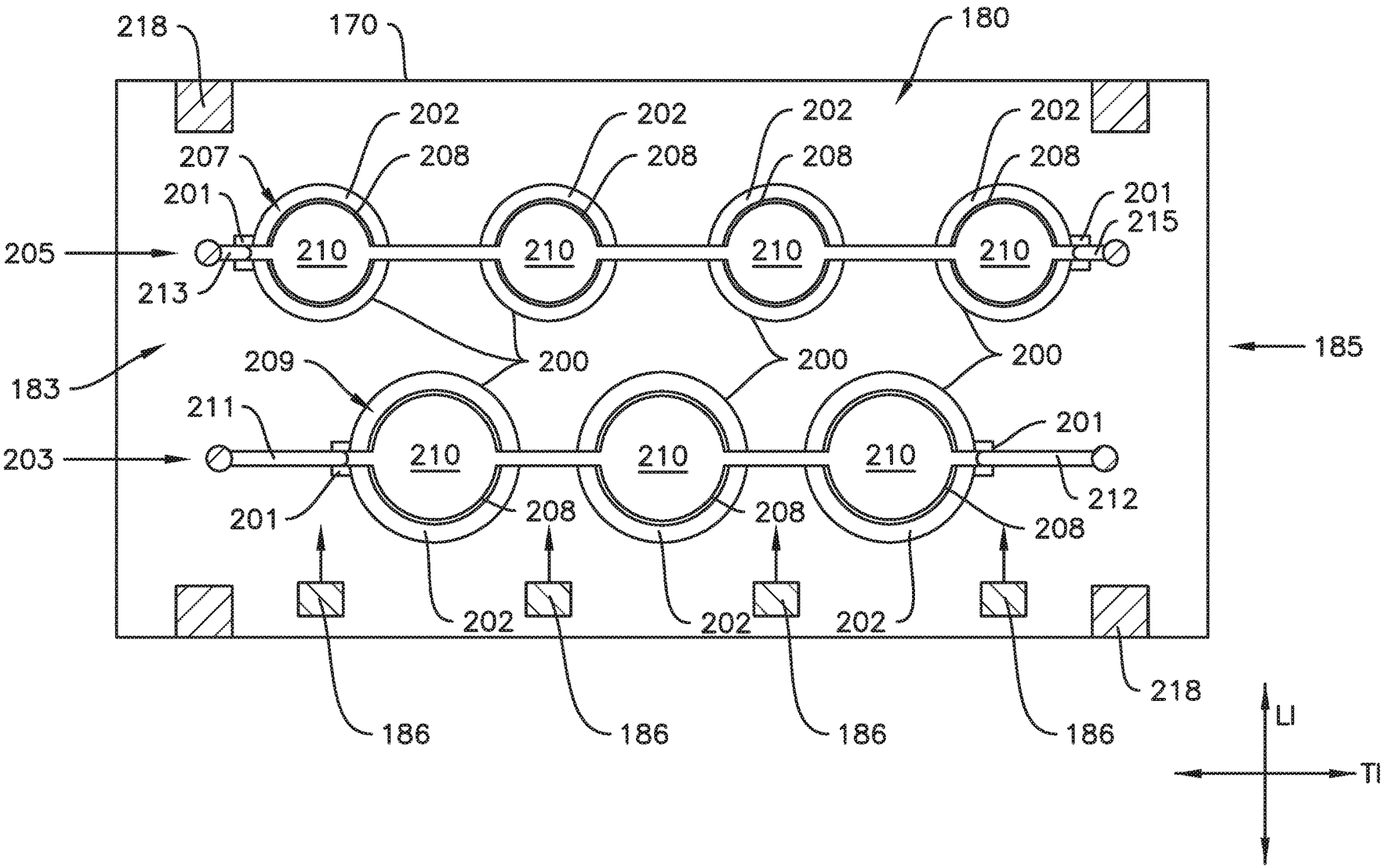
FIG. 10 provides a top-down section view of an ice maker according to one or more additional embodiments of the present subject matter.

As may be seen in FIGS. 9 and 10, the ejector assembly 180 may include a first arm 211 connected to the first row 207 of ejector pads 210 at a first side 183 of the ejector assembly 180 and a second arm 212 connected the first row 207 of ejector pads 210 at a second side 185 of the ejector assembly 180. As shown, the second side 185 of the ejector assembly 180 is opposite the first side 183 of the ejector assembly 180. The ejector assembly 180 may also include a third arm 213 connected to the second row 209 of ejector pads 210 at the first side 183 of the ejector assembly 180 and a fourth arm 214 connected to the second row 209 of ejector pads 210 at the second side 185 of the ejector assembly 180. The arms 211, 212, 213, and 214 may be connected to the scotch yoke 192 and/or the vertical rod 196, and thus may form a part of the operative connection between the motor 174 and the ejector assembly 180. A plurality of notches 201 may be formed in the mold body 170 at opposite ends of each row 203, 205 of mold cavities 200, where the arms 211, 212, 213, and 214 can extend upward outside of the mold cavity 200 so as to avoid or minimize altering the shape of ice produced in the mold body 170 due to the presence of the arms 211, 212, 213, and 214.

In various embodiments, the mold cavities 200 of the first row 203 may be sized and/or positioned relative to the mold cavities 200 of the second row 205 to avoid or minimize ice barrels 1000 from the first row 203 falling into the mold cavities 200 of the second row 205 during ejection of the ice barrels 1000. For example, in some embodiments such as those illustrated in FIGS. 9 and 10, the mold cavities 200 in the first row 203 of mold cavities 200 may be offset from the mold cavities 200 in the second row 205 of mold cavities 200 along the transverse direction TI, e.g., such that the centers of the mold cavities 200 in each of the first row 203 and the second row 205 are not aligned with the centers of the mold cavities 200 in the other of the first row 203 and the second row 205. In some embodiments, the mold cavities 200 in the first row 203 of mold cavities 200 may be the same size as the mold cavities 200 in the second row 205 of mold cavities 200, e.g., as illustrated in FIG. 9. FIG. 10 illustrates an example of other embodiments wherein the mold cavities 200 in the first row 203 of mold cavities 200 are larger than the mold cavities 200 in the second row 205 of mold cavities 200. In embodiments such as the example illustrated in FIG. 10 where the mold cavities 200 in the first row 203 are larger than the mold cavities 200 in the second row 205, ice barrels 1000 formed in the first row 203 of mold cavities 200 will be larger than the mold cavities 200 in the second row 205, whereby ice barrels 1000 formed in the first row 203 of mold cavities 200 are less likely to fall into the mold cavities 200 of the second row 205 during ejection.

Figure 11:
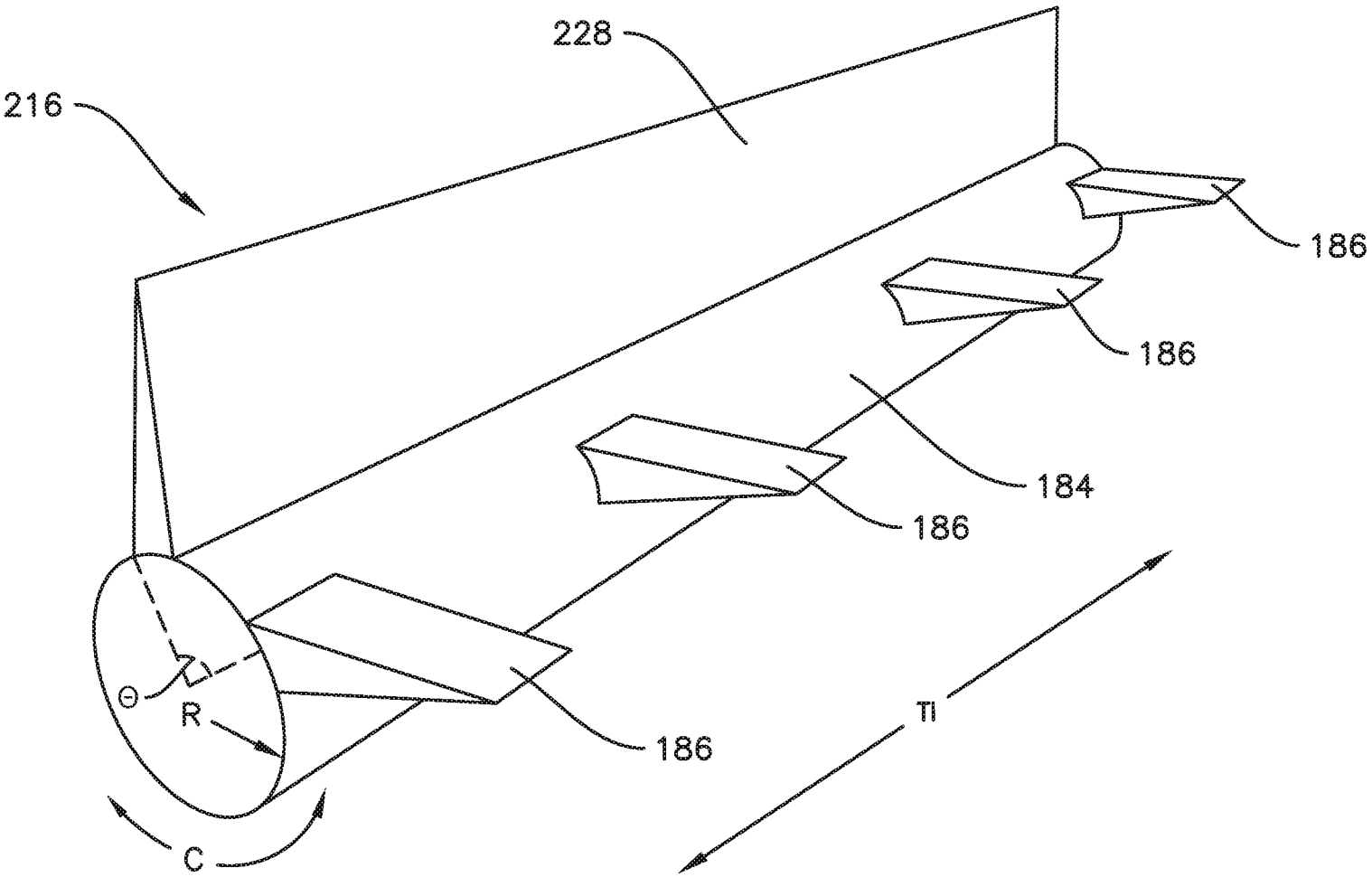
FIG. 11 provides a perspective view of an ice rake of an ice maker according to one or more embodiments of the present subject matter.

As shown, e.g., in FIG. 11, the rake fingers 186 are generally aligned along the circumference C of the rotatable shaft 184. As mentioned above, in some embodiments, the rake fingers 186 may only directly contact ice barrels 1000 formed in one of the first row 203 of mold cavities 200 and the second row 205 of mold cavities 200, e.g., where the total number of rake fingers 186 is the same as the number of mold cavities 200 in one of the first row 203 and the second row 205. In other embodiments, additional rake fingers 186 may be provided which also extend radially from the rotatable shaft 184 and are spaced apart from the first group of rake fingers 186 along the circumference C (FIG. 11) of the rotatable shaft 184. As shown in FIG. 11, the rotatable shaft 184 may include a radius R defining the radial direction, e.g., where the rake fingers 186 extend radially, as mentioned above, the rake fingers 186 extend generally along the radial direction. The rotatable shaft 184 may also include a circumference C and the additional rake fingers 186 may be spaced apart from the first group of rake fingers 186 along the circumference C by an angle θ. In other embodiments, the ice rake 216 may include a blade 228 extending radially outward from the rotatable shaft 184 and spaced apart from the rake fingers 186 along the circumference C of the rotatable shaft 184 by the angle θ. In various embodiments, the angle θ may be between about thirty degrees and about ninety degrees, such as about sixty degrees, such as about forty-five degrees. In embodiments which include the blade 228, the rake fingers 186 may be configured to contact ice barrels 1000 from one of the first row 203 of mold cavities 200 and the second row 205 of mold cavities 200, and the blade 228 may be configured to contact ice barrels 1000 from the other of the first row 203 of mold cavities 200 and the second row 205 of mold cavities 200. For example, the ice rake 216 illustrated in FIG. 11 may be usable with the embodiment illustrated in FIG. 10, e.g., the rake fingers 186 may be spaced apart along the transverse direction TI such that they pass between and around ice barrels 1000 from the first row 203 of mold cavities 200 in order to contact ice barrels 1000 from the second row 205 of mold cavities 200 which are then swept into the ice storage bin 164. As mentioned above, the first row 203 may be offset from the second row 205 and the rake fingers 186 may pass through such offset. For example, as shown in FIG. 10, the mold cavities 200 in the first row 203 may be spaced apart from each other and offset from the mold cavities 200 in the second row 205 such that the centers of the mold cavities 200 in the second row 205 are positioned at or approximately in line with spaces between the mold cavities 200 of the first row 203, such that the rake fingers 186 may pass between and around ice barrels 1000 formed in the first row 203 as the rotatable shaft 184 rotates. Subsequently, as the shaft 184 continues to rotate, the blade 228 may then contact ice barrels 1000 from the first row 203 of mold cavities 200 and sweep the ice barrels 1000 from the first row 203 of mold cavities 200 into the ice storage bin 164. Also, it should be noted that the configuration of the mold cavities 200 illustrated in FIG. 10 is also usable with other embodiments of the ice rake 216 as described herein. For example, the rake fingers 186 could correspond to the mold cavities 200 in the first row 203 in order to sweep the ice barrels 1000 from the first row 203 into ice barrels 1000 from the second row, as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker defining a vertical direction, a lateral direction, and a transverse direction, the vertical, lateral, and transverse directions being mutually perpendicular, the ice maker comprising:

a mold body, a plurality of mold cavities defined in the mold body, the plurality of mold cavities comprising a first row of mold cavities extending generally along the transverse direction and a second row of mold cavities extending generally along the transverse direction and spaced apart from the first row along the lateral direction, each mold cavity of the plurality of mold cavities extending between a floor and an opening along a longitudinal axis, each mold cavity of the plurality of mold cavities enclosed by at least one sidewall between the floor and the opening, the longitudinal axis of each mold cavity oriented generally along the vertical direction;

an ejector assembly comprising a plurality of ejector pads, the plurality of ejector pads comprising a first row of ejector pads corresponding to the first row of mold cavities and a second row of ejector pads corresponding to the second row of mold cavities, each ejector pad disposed proximate to the floor of a corresponding mold cavity of the plurality of mold cavities when the ejector assembly is in a low position;

an ice rake positioned above the mold body along the vertical direction, the ice rake comprising a rotatable shaft and a rake finger extending radially outward from the rotatable shaft;

a gear directly connected to the rotatable shaft of the ice rake;

a cam formed on the gear, the cam connected to the ejector assembly via a scotch yoke; and a motor in operative communication with the ejector assembly via the cam and the gear, the motor operable to rotate the gear, wherein rotation of the gear and the cam thereon is translated into linear movement by the scotch yoke to move the plurality of ejector pads upward generally along the vertical direction from the low position to a high position proximate the opening of each corresponding mold cavity, wherein each ejector pad is operable to eject ice from the corresponding mold cavity when the ejector pad moves from the low position to the high position.

2. The ice maker of claim 1, wherein the floor of each mold cavity of the plurality of mold cavities defines a solid and continuous surface.

3. The ice maker of claim 1, wherein the mold cavities in the first row of mold cavities are the same size as the mold cavities in the second row of mold cavities.

4. The ice maker of claim 1, wherein the mold cavities in the first row of mold cavities are larger than the mold cavities in the second row of mold cavities.

5. The ice maker of claim 1, wherein the mold cavities in the first row of mold cavities are offset from the mold cavities in the second row of mold cavities along the transverse direction.

6. The ice maker of claim 1, wherein the rotatable shaft of the ice rake is positioned directly above the first row of mold cavities along the vertical direction.

7. A refrigerator appliance comprising:

a cabinet defining a chilled chamber;

an ice maker disposed within the cabinet, defining a vertical direction, a lateral direction, and a transverse direction, the vertical, lateral, and transverse directions being mutually perpendicular, the ice maker comprising:

a mold body, a plurality of mold cavities defined in the mold body, the plurality of mold cavities comprising a first row of mold cavities extending generally along the transverse direction and a second row of mold cavities extending generally along the transverse direction and spaced apart from the first row along the lateral direction, each mold cavity of the plurality of mold cavities extending between a floor and an opening along a longitudinal axis, each mold cavity of the plurality of mold cavities enclosed by at least one sidewall between the floor and the opening, the longitudinal axis of each mold cavity oriented generally along the vertical direction;

an ejector assembly comprising a plurality of ejector pads, the plurality of ejector pads comprising a first row of ejector pads corresponding to the first row of mold cavities, a second row of ejector pads corresponding to the second row of mold cavities, a first arm connected to the first row of ejector pads at a first side of the ejector assembly, and a second arm connected to the first row of ejector pads at a second side of the ejector assembly, the first arm and the second arm extending upward along the vertical direction from the first row of ejector pads, each ejector pad disposed proximate to the floor of a corresponding mold cavity of the plurality of mold cavities when the ejector assembly is in a low position; and a motor in operative communication with the ejector assembly, the motor operable to move the plurality of ejector pads upward generally along the vertical direction from the low position to a high position proximate the opening of each corresponding mold cavity, wherein each ejector pad is operable to eject ice from the corresponding mold cavity when the ejector pad moves from the low position to the high position.

8. The refrigerator appliance of claim 7, wherein the floor of each the mold cavity of the plurality of mold cavities defines a solid and continuous surface.

9. The refrigerator appliance of claim 7, wherein the mold cavities in the first row of mold cavities are the same size as the mold cavities in the second row of mold cavities.

10. The refrigerator appliance of claim 7, wherein the mold cavities in the first row of mold cavities are larger than the mold cavities in the second row of mold cavities.

11. The refrigerator appliance of claim 7, wherein the mold cavities in the first row of mold cavities are offset from the mold cavities in the second row of mold cavities along the transverse direction.

12. The refrigerator appliance of claim 7, wherein the ice maker further comprises an ice rake positioned above the mold body along the vertical direction, the ice rake comprising a rotatable shaft and a rake finger extending radially outward from the rotatable shaft.

13. The refrigerator appliance of claim 12, wherein the rotatable shaft is positioned directly above the first row of mold cavities along the vertical direction.

14. The refrigerator appliance of claim 12, wherein the ice rake includes a blade extending radially outward from the rotatable shaft.

15. The refrigerator appliance of claim 12, wherein the ice maker further comprises a cam connected to the rotatable shaft.

16. The refrigerator appliance of claim 15, wherein the cam is connected to the ejector assembly via a scotch yoke, whereby rotation of the rotatable shaft and the cam connected thereto is translated into linear movement to move the ejector assembly from the low position to the high position.

* * * * *